United States Patent [19]

Graham, Jr. et al.

[11] 4,067,509

[45] * Jan. 10, 1978

[54] PAPER TOWEL DISPENSER AND TRANSFER MECHANISM

[75] Inventors: Andrew Stuard Graham, Jr., Wyncote; Coleman David Berg, Philadelphia, both of Pa.

[73] Assignee: Fort Howard Paper Company, Greenbay, Wis.

[ * ] Notice: The portion of the term of this patent subsequent to Nov. 4, 1992, has been disclaimed.

[21] Appl. No.: 616,730

[22] Filed: Sept. 25, 1975

Related U.S. Application Data

[60] Division of Ser. No. 391,655, Aug. 27, 1973, Pat. No. 3,917,191, which is a continuation-in-part of Ser. No. 243,230, April 12, 1972, abandoned.

[51] Int. Cl.[2] ..... A47K 10/38

[52] U.S. Cl. ..... 242/55.3; 242/55.53

[58] Field of Search ..... 242/55.3, 55.53, 58, 242/58.4; 312/39

[56] References Cited

U.S. PATENT DOCUMENTS

| | | | |
|---|---|---|---|
| 2,974,839 | 3/1961 | Batlas et al. | 242/58.4 X |
| 3,628,743 | 12/1971 | Bastian et al. | 242/55.3 |
| 3,917,191 | 11/1975 | Graham, Jr. et al. | 242/55.53 |

*Primary Examiner*—George F. Mautz

*Attorney, Agent, or Firm*—Cullen, Settle, Sloman & Cantor

[57] ABSTRACT

A roll paper towel dispenser having stations for primary and reserve rolls of paper toweling. Provision is made for automatic transfer of feed of the paper toweling from the primary roll and then from the reserve roll, the transfer mechanism being operative under the influence of decrease or termination in the tension of the web running from the primary roll to the feed mechanism. Provision is also made for convenient shifting of the roll from the reserve roll station to the primary roll station without the necessity of rethreading the paper web through the feed mechanism.

6 Claims, 11 Drawing Figures

FIG. 7
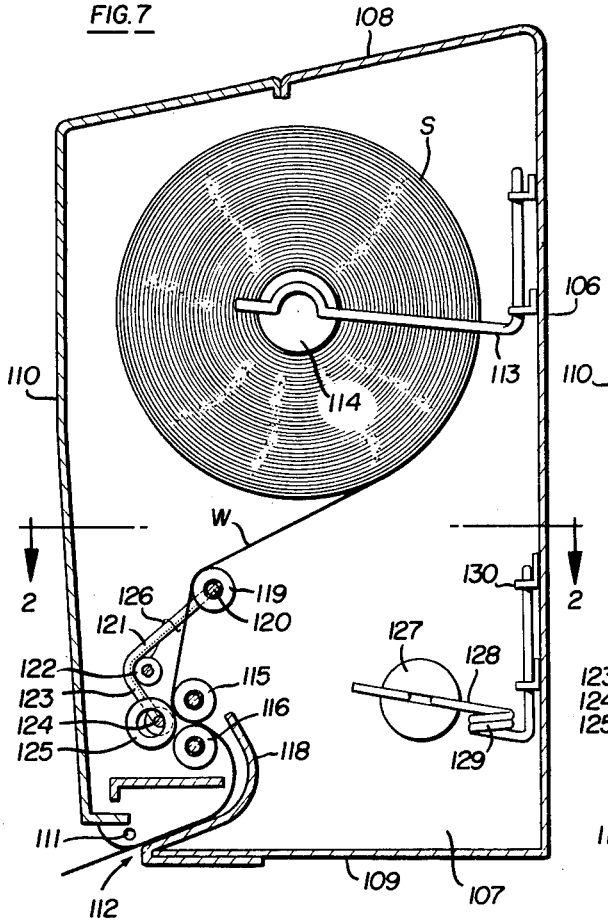
FIG. 9
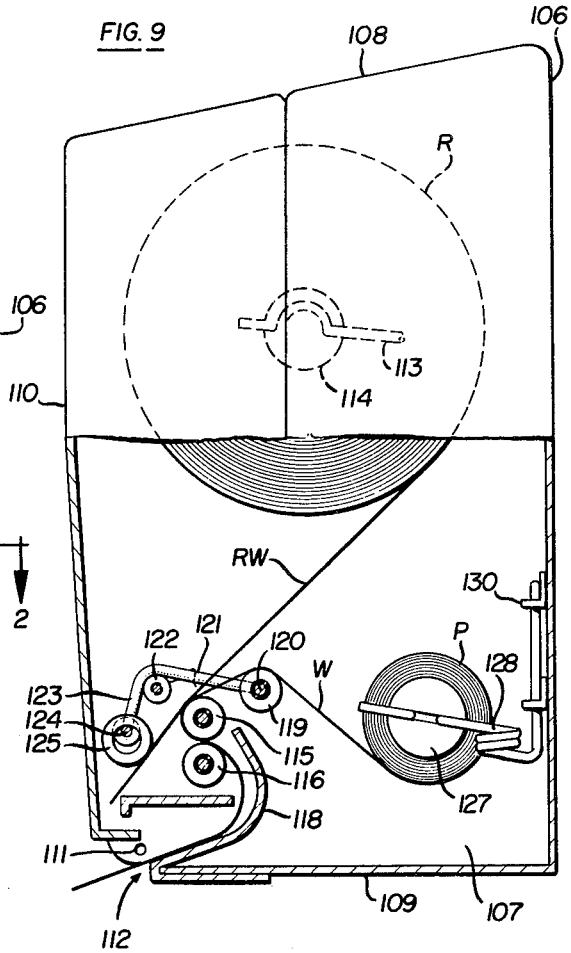
FIG. 8
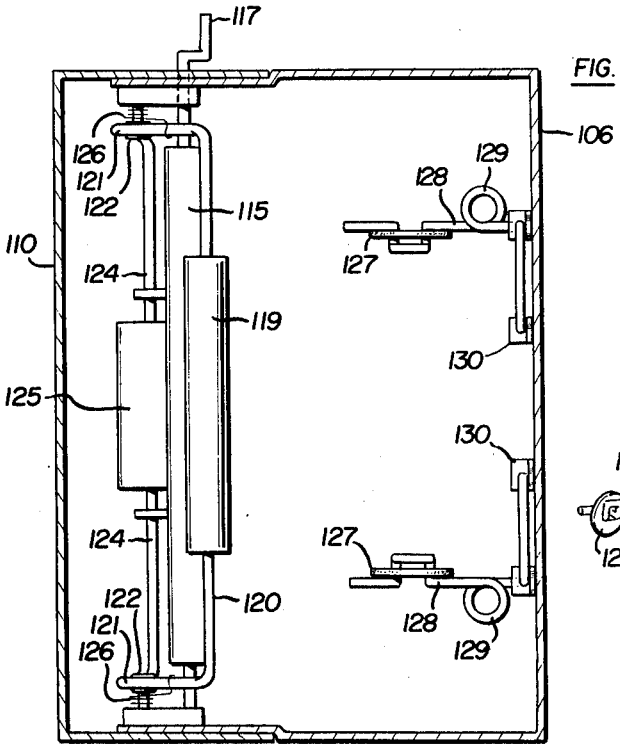
FIG. 10
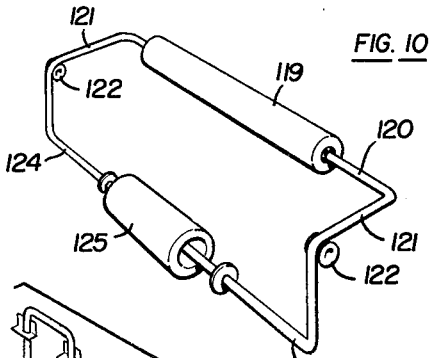
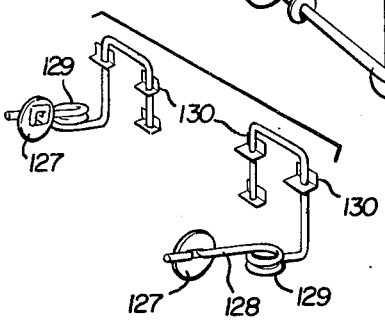
FIG. 11

PAPER TOWEL DISPENSER AND TRANSFER MECHANISM

REFERENCE TO RELATED APPLICATIONS

This application is a Divisional application of our copending application for U.S. Patent, Ser. No. 391,655, filed Aug. 27, 1973, now U.S. Pat. No. 3,917,191, which application was a continuation-in-part application of our copending application, Ser. No. 243,230, filed Apr. 12, 1972, now abandoned.

FIELD OF THE INVENTION

This invention relates to roll paper dispensers, especially such dispensers as employed in the dispensing of paper toweling. Moreover, the invention is particularly concerned with roll paper dispensers having at least two paper roll stations, for accommodating primary and reserve paper rolls and in which provision is made for automatic transfer of the paper feed from the primary roll and then from the reserve roll at or close to the point of exhaustion of the paper web of the primary roll. After the feed has been transferred to the reserve roll, the loading or refilling operation involves a shifting in position of the reserve roll to the station previously occupied by the primary roll and a new reserve roll is then inserted in the reserve station.

DESCRIPTION OF THE PRIOR ART

Various dispensers of this general kind are already known, and the present invention contemplates an improved arrangement of a dispenser of this kind in which the operation of loading or refilling is greatly simplified as compared with various prior dispensers. For example, whereas in some prior arrangements when the reserve roll is moved to the station of the primary roll (to make room for a new reserve roll) it is necessary to break or tear the paper web and, after insertion of the roll into the primary roll station, the web must be re-threaded through the feed mechanism. This is distinctly inconvenient. In addition, various of the prior known arrangements require displacement of several parts of the mechanism in order to permit re-threading of the dispenser and, for practical purposes, it is not feasible to use dispenser equipment of any type where the re-threading operation is complex or inconvenient.

SUMMARY OF INVENTION

In accordance with the present invention the dispenser automatically transfers from the primary to the reserve roll under the influence of termination of tension in the web of paper running from the primary roll to the feed and dispensing mechanism, so that the transfer will occur when the primary is exhausted or when the web of the primary roll is broken. It is an objective of the invention to provide for the shifting of the position of the reserve roll to the primary roll station, merely by moving the reserve roll to the station formerly occupied by the primary roll without the necessity of breaking the paper web or re-threading the paper through the feed and dispensing mechanism.

It is another object of the invention to provide a dispenser of the automatic transfer type in which the primary and reserve paper rolls may be inserted in either position, i.e., to provide for feed of the web from either the upper or lower side of the roll. This further simplifies re-threading and assures that proper operation will be maintained regardless of the position in which the rolls are inserted.

In the second embodiment of the transfer mechanism of this invention, an element is employed for moving the reserve web into the feed mechanism which includes a laterally movable element capable of positional self-adjustment, such that the reserve paper web is brought accurately into the feed nip formed by the feed rollers. This improvement provides maximum reliability in the transfer of function. Further, in this embodiment, a novel means for mounting the primary roll is provided which maintains the tension in the web extended from the primary roll, thereby insuring the feed of the web from the primary roll until exhaustion. Again, the transfer mechanism will feed the web of the reserve roll if the web of the primary roll is accidently broken.

Other advantages and meritorious features of the disclosed invention will be more fully understood from the description of the preferred embodiments, the appended claims and the drawings, a description of which follows:

DESCRIPTION OF DRAWINGS

FIG. 7 illustrates another embodiment of the towel dispenser of this invention in vertical section.

FIG. 8 is a horizontal sectional view of the elements of the dispenser shown in FIG. 7, in the direction of view arrows 8—8 in FIG. 7.

FIG. 9 is a vertical section view, similar to FIG. 7, illustrating a condition in the dispenser when the primary roll is nearing exhaustion and has been moved to the lower or primary roll station, with a new reserve roll placed in the reserve roll station.

FIG. 10 is an isometric view of the portion of the transfer mechanism shown in FIGS. 8 and 9, and FIG. 11 is an isometric view of the mounting bracket for the primary roll in the primary station.

DESCRIPTION OF THE PREFERRED EMBODIMENTS

Figure 1:
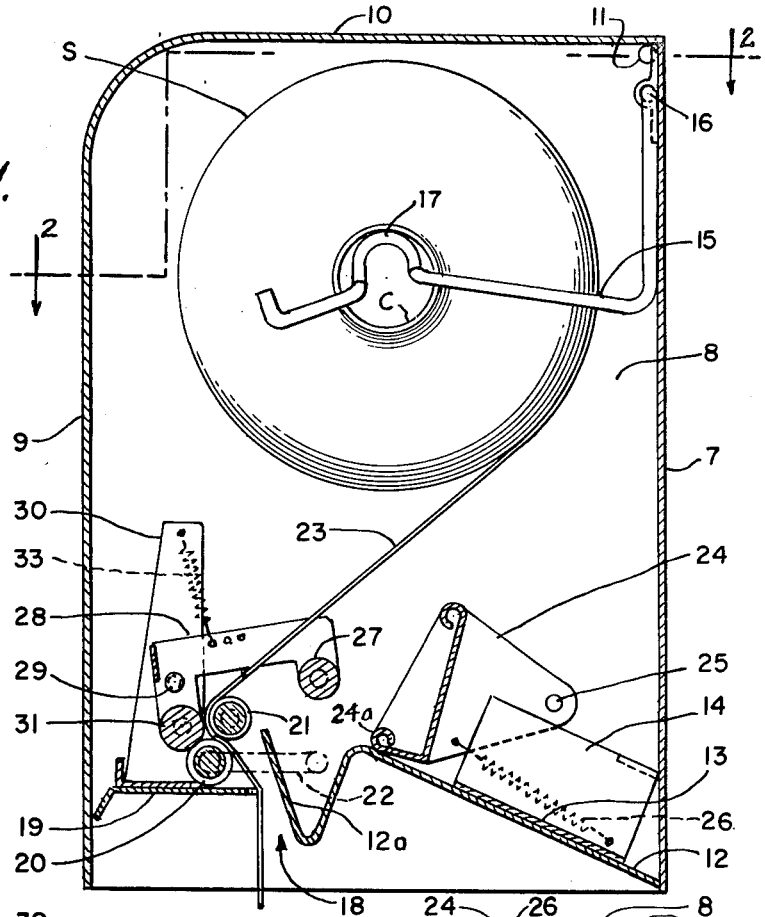
FIG. 1 illustrates a preferred form of the dispenser in vertical section, this view being taken as indicated by the section line 1—1 of FIG. 2.
Figure 2:
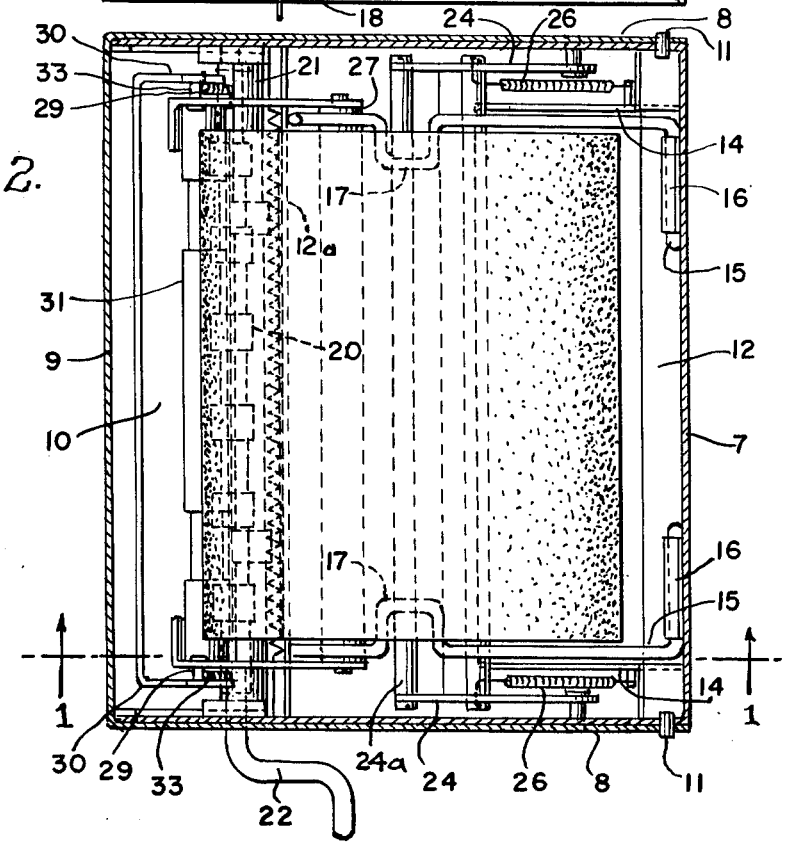
FIG. 2 is a horizontal sectional view taken as indicated by the section line 2—2 to FIG. 1.

In the embodiment illustrated in FIGS. 1 to 6, the dispenser is provided with a back wall 7, which is usually fastened to a support, side walls 8,8, and a cover comprising a front wall 9 and a top wall 10; the cover being pivoted to the remaining cabinet structure by means of pivots 11,11 so that the cover may be swung upwardly and thus fully expose the interior of the cabinet.

The cabinet is provided with stations for accommodating primary and reserve paper rolls, it being understood that these terms "primary" and "reserve" are used to refer respectively to the roll which is respectively supplying the paper toweling and to the roll which is in reserve for subsequent dispensing of the paper toweling.

The station for the primary roll is provided in the cabinet by a cabinet wall 12 inclined upwardly and forwardly from the lower edge of the back wall of the cabinet. This forms a pocket in the back rear corner of the cabinet for accommodating the primary roll, for instance, the roll indicated at P in FIGS. 4 and 5. The lateral position of the primary roll in the primary roll station may be established by angle brackets having lower portions 13 overlying and secured to the inclined wall 12 and further having upright portions 14 positioned just beyond the ends of the primary roll.

The reserve paper roll station is established by a pair of bent wire elements 15,15 one end of each of which is fastened as at 16 to the inner surface of the back wall 7, these wire supports 15 having inwardly bent portions 17 adapted to be inserted into ends of the core "C". A roll such as the paper supply roll indicated at S in FIG. 1 may readily be mounted in the reserve paper station or removed therefrom merely by outwardly flexing the wire supports 15.

The channel or throat through which the paper is delivered from the cabinet is indicated at 18, being formed between a forward, upward bent edge **12*a* of the inclined wall 12 and the transverse strip or bracket 19 provided to support the paper feed mechanism. The paper feed mechanism includes the drive roller 20 and the pressure roller 21, the latter preferably having rubber rings or friction material thereon cooperating with the drive roller 20 in the feed of the paper in a manner which is well understood in this art. The drive roller 20 is provided with an operating handle 22 extended through the adjacent side wall of the cabinet to a position for convenient access (see FIG. 2**).

Figure 3:
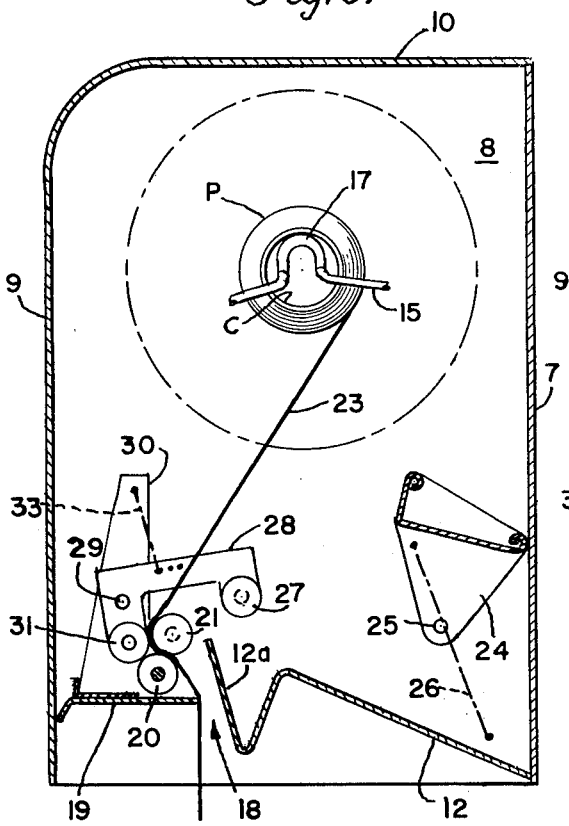
FIG. 3 is a view similar to FIG. 1 but illustrating the condition where only a small amount of the roll remains.
Figure 4:
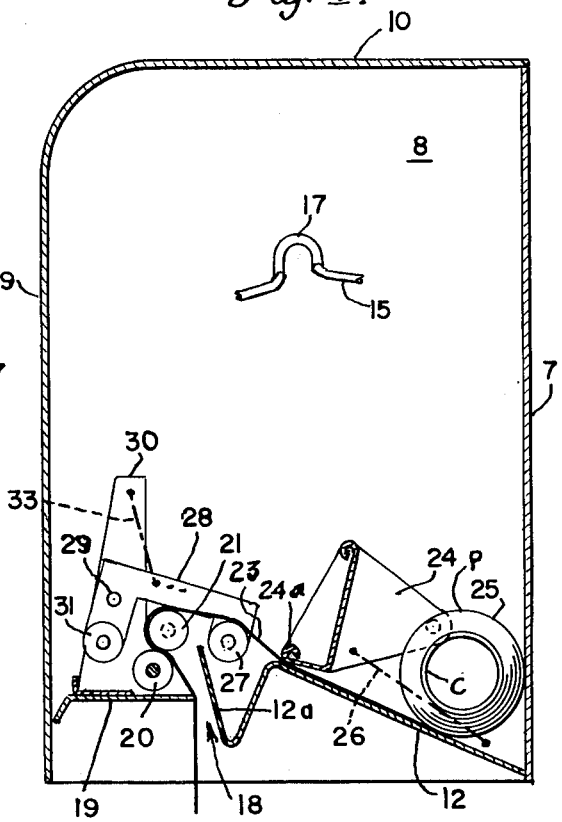
FIG. 4 is a similar view but showing the shift in position of the upper roll to the lower or primary roll station.

With the cabinet in the condition illustrated in FIG. 1, a supply roll of paper S is shown as mounted by the spring supports with its web 23 extended from the roll around the forward portion of the pressure roller 21 into and through the nip between the rollers 20 and 21 and thence downwardly through the dispensing throat 18. In FIG. 1 only a single roll is shown and this may be considered as representing an initial loading condition of the cabinet; the roll S occupying the reserve roll station. After use of some appreciable quantity of paper from the roll S, for instance when the roll has been diminished to the size indicated at P in FIG. 3, this roll which may be considered as the primary roll, is then moved to the primary roll station, in which the roll is illustrated in FIG. 4. For the purpose of accomplishing this shift of this roll P from the position illustrated in FIG. 3 to the position illustrated in FIG. 4, the friction or pressure foot 24 is pivoted upwardly about the pivot 25. The friction device 24 is shown in lowered position in FIGS. 1 and 4 but in the upwardly pivoted position in FIG. 3. A pair of springs 26,26 serves to urge the friction device 24 downwardly when it has been pivoted in the downward direction and serves also to retain the device 24 in its upwardly pivoted position as shown in FIG. 3, because of the "over center" relationship of the spring to the axis of the pivots 25.

Referring again to FIG. 3, when the device 24 is in its up position as there shown, it will be seen that the primary roll P may then readily be removed from the spring support 15 and dropped into the primary roll station as shown in FIG. 4, whereupon the device 24 may be dropped to its lower position as is also shown in FIG. 4.

Attention is now called to the primary roll P in the primary station, as in FIG. 4. The web 23 of this roll extends under the friction or pressure foot **24*a* of the device 24 and thence over a feeler or sensing roller or device 27. This device is mounted by means of a pair of double ended arms 28 which are pivoted at 29,29 on the brackets 30,30 projecting upwardly from the support 19**.

The double ended arms 28 also carry the transfer roller 31, the purpose and functions of which will be described below.

Figure 5:
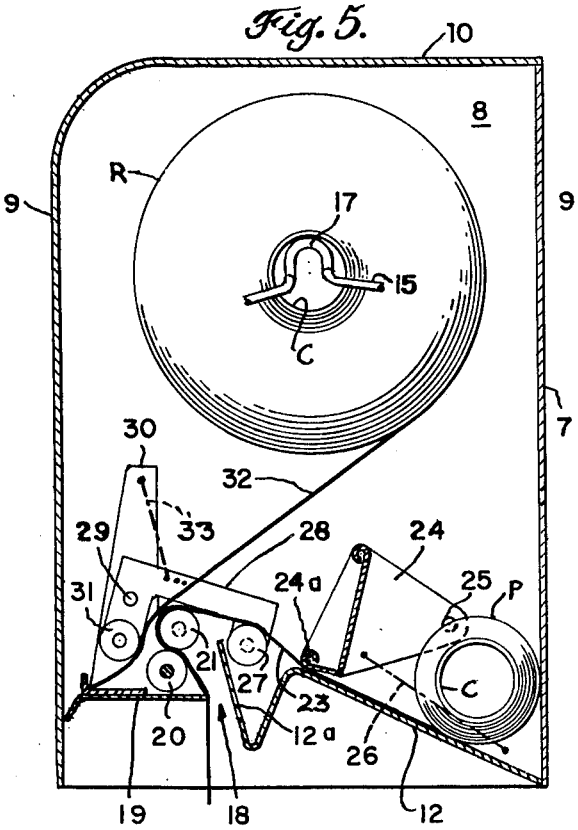
FIG. 5 is a similar view but further illustrating the insertion of a new reserve roll in the upper station.
Figure 6:
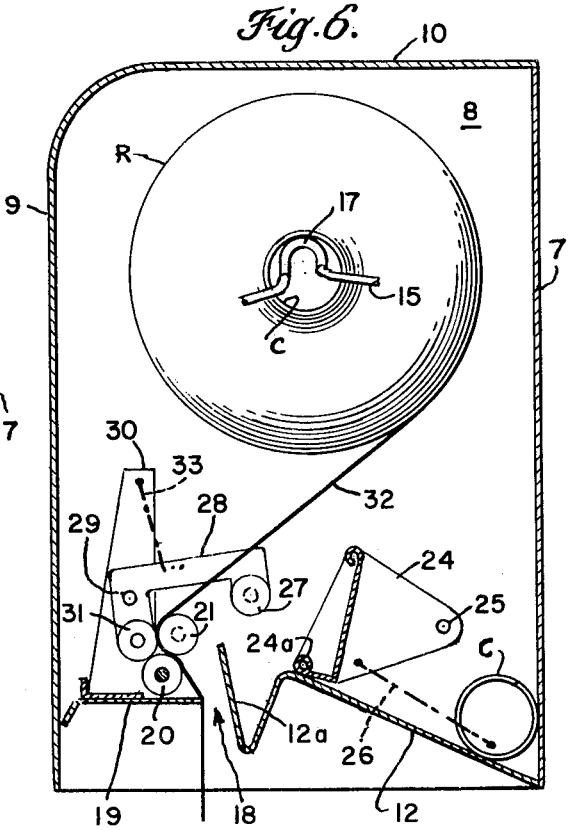
FIG. 6 is a view similar to FIG. 5 but illustrating the condition after exhaustion of the paper on the lower roll and transfer of the feed to the roll in the upper station.

With the cabinet in the condition illustrated in FIG. 4, an attendant may also introduce a reserve roll of paper indicated at R in FIG. 5. This roll is mounted in the reserve paper station provided by the spring supports 15, and the leading end of the web 32 is drawn downwardly and introduced between the transfer roll 31 and the pair of feed rollers 20 and 21 as is illustrated in FIG. 5. In this condition illustrated in FIG. 5, feed of the paper will continue drawing the web 23 from the primary roll P and the web 32 from the reserve roll R will remain stationary in the position illustrated; there being no driving or feeding force applied to the web 32 in that position of the parts. This condition is maintained so long as there is any appreciable tension in the web 23. In this position the transfer roller 31 is retained in its position shown in FIG. 5, i.e., spaced from the entrance nip of the feed rollers 20 and 21.

The condition above described is maintained until the tension in the web 23 is relieved, and this normally occurs when the trailing end of the web 23 leaves the core C of the primary roll. At that time the springs 33,33 acting on the double ended arms 28 move the double ended arms about the pivots 29 to the position shown in FIG. 6. In consequence, the leading end of the web 32 of the reserve roll is delivered by the transfer roller 31 into the nip between the feed rollers 20 and 21, with the result that the paper feed now occurs by withdrawing the web 32 from the roll which had been occupying the position of the reserve roll. This condition again continues until the roll R is moved to the primary roll station, as in FIG. 4. It will be understood that the empty core C of the roll which had previously been in the lower or primary station will be removed and discarded before the roll R is transferred from the reserve station to the primary station. It is understood that the tension in the web 23 may also be interrupted if the web is broken. In this case, the transfer mechanism will automatically begin feeding the web 32 from the reserve roll, as shown in FIG. 5.

The embodiment of the dispenser shown in FIGS. 7 to 11 may be similar in many details to the dispenser shown in FIGS. 1 to 6 with the improvements described below. As described above, the cabinet for the dispenser includes a back wall 106, side walls 107,107 and top and bottom walls 108 and 109, respectively. A displaceable lid or closure 110 is pivotally connected with the remainder of the cabinet by pivots indicated at 111. The lid is thus capable of being opened by swinging the lid outwardly and downwardly to expose the interior of the cabinet in order to provide for shifting of the reserve or upper roll to the lower or primary roll station and for loading a new reserve roll, as described above in regard to FIGS. 1 to 6. The toweling is delivered from the cabinet through a dispensing opening provided in the lower forward corner of the cabinet, between the bottom wall 109 and the closure 110, as indicated at 112 in FIGS. 7 and 9.

Rolls of toweling, for example paper toweling, commonly have a central core by means of which the roll may be mounted. In the upper portion of the cabinet, a pair of spring arms 113 are mounted on the back wall 106 and extend forwardly to carry roll mounting elements 114 which are configured to be received in the ends of the roll core and provide a mounting axis for a roll of paper or the like in the upper portion of the cabinet. This mounting establishes the station for the reserve roll of paper, as described above. In FIG. 7, only a single roll S of paper is illustrated, with the web W thereof extending downwardly to and through the feed mechanism described below.

The feed mechanism comprises a pair of feed rollers 115 and 116, similar to the feed rollers 20 and 21 in FIGS. 1 to 6. Feed roller 116 is provided with a shaft having an operating crank or handle 117 projecting at one side of the cabinet (see FIG. 8) providing for manual activation of the feed rollers. The roller 116 is therefore the driven roller and advantageously the roller 115 comprises a pressure roller, preferably having rubber rings or friction material, as described above, cooperating with the drive roller 116 in the feed of toweling in the manner as described above and understood in this art.

It will be seen from FIG. 7 that the web W of the roll S is threaded downwardly in front of the roller 115 and then rearwardly through the nip provided between the rollers 115 and 116 from which the web extends downwardly and forwardly in front of the paper guide 118, to be delivered from the cabinet through the dispensing opening 112.

As described above and shown in FIG. 7, the paper web from the roll S first passes in front of the roller 119 and then downwardly to a pair of feed rollers 115 and 116. The roller 119 is mounted on a rod or shaft 120 (see also FIG. 10). The rod 120 includes arms 121,121, which are pivotally mounted at 122,122. The rods are further extended beyond the pivot points, as indicated at 123,123 in FIG. 4, in order to mount the shaft 124 by means of which the roller 125 is carried. The parts 119 to 125 comprise the transfer mechanism and this assembly is biased about the axis provided by pivots 122,122 to the position shown in FIG. 7 by means of springs 126, one of which is associated with the parts adjacent the pivots at each side of the cabinet, as described above and shown in FIGS. 7 and 8.

The operation of this embodiment of the dispenser to feed the web RW of the reserve roll R when the primary roll P is exhausted has been described above and need not be described here in detail. Briefly, when some appreciable quantity of the paper from roll S has been dispensed (see FIG. 7) its diameter will be reduced so that it may readily be accommodated by the lower or primary roll station provided in the lower back of the cabinet. This partially used roller is shown in the primary roll station and is indicated in FIG. 9 by the letter P. In this lower or primary station, the roll is mounted by means of a pair of core engaging elements 127,127, see also FIG. 11. These elements are mounted by means of spring arms 128,128, each of which has a spring loop 129. The spring arms 128 are mounted on the back wall of the cabinet by brackets 130 and in this way the arms are supported and in position in which they are urged inwardly towards each other, at opposite ends. The elements 127,127 frictionally engage the ends of the roll core, thereby imposing drag upon the paper web being dispensed from the roll in this station, eliminating the requirement of a pressure foot, as shown at 24 in FIGS. 3 to 6. The use of the friction or drag on the primary roll P cooperates with the paper feed mechanism, including the hand operated lever 117 in establishing tension in the web W from the primary roll. That is, the run of the web from the roll in the primary station to the feed mechanism is tensioned and displaces the trigger or feeler 119 to the position illustrated in FIG. 9. In consequence of this, the transfer roll 125 is displaced forwardly, away from and out of the nip between the feed rollers 115 and 116.

When servicing the dispenser, the attendant places a fresh roll in the upper station, as described above, which is the reserve station, as shown at R in FIG. 9. Roll R comprises the reserve roll from which the web RW will be fed when the web from the primary roll is exhausted or the tension in the web is broken. It will be seen from FIG. 9 that the web RW is initially drawn downwardly with its leading end loosely inserted between the transfer roll 125 and the feed mechanism, as described above. With the parts in this position, the web RW will not be dispensed, but the leading end will merely remain adjacent the feed mechanism in preparation for delivery.

As described above, when the web W of the primary roll P is completely exhausted or the tension in the web is interrupted, the springs 126 acting on the transfer assembly parts 119 to 125, inclusive, cause the trigger or feeler 119 to rise from the position shown in FIG. 9 to the position shown in FIG. 7. The transfer roller 125 will move rearwardly, forcing the web RW into the nip between the feed rollers 115 and 116, thus initiating the dispensing of the web from the reserve roll. This condition will then continue until the attendant again services the cabinet, at which time he will remove the core of the primary roll and reposition the reserve roll from the upper or reserve station to the lower or primary station as described above.

It will be noted, particularly from FIGS. 7, 9 and 10, that the transfer roller 125, which is mounted on the rod 124, has an internal diameter substantially larger in diameter than the external diameter of the rod 124. In the disclosed embodiment, the internal diameter of the transfer roller is approximately twice the external diameter of the rod 124. The mounting of the transfer roller in this manner provides for self-adjustment movement of the transfer roller to accurately fit and engage in the feed nip between the feed rollers 115 and 116. Consequently, the web of the reserve roll is brought accurately into engagement with the feed nip and this enhances reliability of the transfer function. The arrangement of this transfer element to have the capability of self-adjustment movement is highly advantageous and compensating for manufacturing inaccuracies and permits the utilization of the relatively simple and inexpensive wire construction shown in FIG. 11.

The provision of the spring coils or spring turns 129 in the arms 128 is of importance in providing the desired degree of friction on the roll core, tensioning the web as described above. It is also preferable to provide spring arms of relatively short length to accommodate the mounting of the primary roll close to the back wall of the cabinet, in the space behind the feed and transfer mechanisms.

It will be seen from the description of the embodiments above that the towel dispenser of this invention is exceedingly simple and reliable and has the further advantage that the transfer of feet from one roll to another normally occurs only at a point very close to the end of the primary roll, thus avoiding paper waste incident to feed of a portion of the leading end of the reserve roll web along with a portion of the trailing end of the primary roll web.

Further, the reserve roll may be transferred from the reserve roll station to the primary roll station without rethreading of the web through the feed rollers and in the embodiment shown in FIGS. 7 to 11, the reserve roll may be transferred without any adjustment of the internal mechanism.

We claim:

1. A towel dispenser for sequentially dispensing toweling from rolls, permitting reloading of the dispenser without rethreading of the feed mechanism, comprising:

a cabinet having a dispensing opening, a primary roll station rotatably supporting a primary towel roll, a reserve roll station located above said primary roll station in spaced relation and rotatably supporting a reserve towel roll, an unobstructed path between said primary and reserve roll stations permitting manual shifting of a towel roll from the reserve to primary roll station, a feed mechanism located generally between said primary roll station and said dispensing opening sequentially receiving the web from the towel rolls in the primary and reserve roll stations in separate paths and dispensing toweling through said dispensing opening, and a transfer means having a movable sensing element in the path of the primary roll web spaced from the primary roll and normally engaging the web of the primary roll between said primary roll station and said feed mechanism and responsive to exhaustion of said primary towel roll to deliver the web of the reserve towel roll to said feed mechanism upon exhaustion of said primary towel roll, said feed mechanism and said transfer means being spaced during operation from said primary roll station a distance sufficient to permit a towel roll to be transferred from said reserve roll station to said primary roll station without breaking the web running to said feed mechanism, rethreading said feed mechanism or movement of said sensing element.

2. A towel dispenser for sequentially dispensing toweling from rolls supported within the dispenser and permitting reloading of the dispenser without disengagement of the feed mechanism, comprising a cabinet having a primary roll station for rotatably supporting a primary towel roll in a relatively fixed axis, and having a reserve roll station for rotatably supporting a reserve towel roll, the primary and reserve roll stations being spaced from each other in the cabinet and the cabinet having a path between said stations to provide for manual shifting of a roll from the reserve station to the primary station, a feed mechanism for sequentially receiving, engaging and dispensing the towel webs extending respectively in first and second feed paths from the rolls in the primary and reserve stations, a transfer means for transferring the web of a towel roll in said reserve station to said feed mechanism, said transfer means including a movable sensing element located in said first feed path of the primary towel roll and engaging the run of the primary towel web in said first path at a point spaced from the roll in the primary station and responsive to exhaustion of the primary towel web to actuate the transfer means and deliver the web of the reserve towel roll to said feed mechanism and thereby initiate dispensing of the web from the reserve towel roll, and means for mounting said sensing element during operation in a position with relation to both of said feed paths which permits manual shifting of a towel roll from said reserve station to said primary station after transfer of the web thereof to the feed mechanism, without disengagement of the feed mechanism from the web of the roll being shifted or movement of said sensing element.

3. A towel dispenser for sequentially dispensing toweling from rolls supported within the dispenser permitting reloading of the dispenser without disengagement of the feed mechanism, comprising a cabinet having a primary roll station for rotatably supporting a primary towel roll with the primary towel roll maintained in a substantially fixed position and having a reserve roll station for rotatably supporting a reserve towel roll, the primary and reserve roll stations being spaced from each other in the cabinet, said cabinet having an unobstructed path and said stations arranged to provide for manual shifting of a roll from the reserve roll station to the primary roll station, a feed mechanism for sequentially receiving the towel webs from the rolls in the primary and reserve stations in first and second feed paths for dispensing toweling, a transfer means for transferring the web of a towel roll in said reserve station to said feed mechanism, said transfer means including a sensing element in said first path of the primary towel web engaging the primary towel web in the run thereof extending from a roll in the primary station to said feed mechanism and responsive to exhaustion of the primary towel web to actuate the transfer means and deliver the web of a towel roll in the reserve station to said feed mechanism and thereby initiate dispensing of the web from the reserve towel roll, and means for mounting the transfer means in the cabinet, the relative positioning of the transfer means and its mounting means in relation to the feed mechanism and to the primary and reserve roll stations during operation providing for manual shifting of a towel roll from said reserve station to said primary station after transfer of the web thereof to the feed mechanism, without disengagement of the feed mechanism from the web of the roll being shifted or movement of said sensing element.

4. A towel dispenser for sequentially dispensing toweling from rolls, comprising:

an enclosing cabinet having a dispensing opening;

a primary roll station for rotatably supporting a primary towel roll;

a reserve roll station for rotatably supporting a reserve towel roll in spaced relation above said primary roll station;

a feed mechanism including web driving means located between said dispensing opening and each of said primary and reserve roll stations and adapted to sequentially receive the towel web from said primary and reserve roll stations and to advance such web and dispense it through said dispensing opening;

said feed mechanism further including a sensing element adapted to engage said primary web at a point remote from the primary towel roll, said sensing element being responsive to the interruption of continuity of the primary web at least one predetermined point between said web driving means and the primary towel roll to deliver the web from the reserve roll station to said web driving means for advancing and dispensing thereby;

the cabinet interior being so constructed that an unobstructed path is provided during operation to permit the reserve towel roll to be manually transferred from said reserve towel station to said primary towel station after the reserve web has been delivered to and engaged by said web driving means, without breaking such web, rethreading it through said feed mechanism or movement of said sensing element.

5. A towel dispenser for sequentially dispensing toweling from rolls, comprising:

an enclosing cabinet having a dispensing opening;

a primary roll station for rotatably supporting a primary towel roll;

a reserve roll station for rotatably supporting a reserve towel roll in spaced relation above said primary roll station;

a feed mechanism including web driving means located between said dispensing opening and each of said primary and reserve roll stations and adapted to sequentially receive the towel web from said primary and reserve roll stations and to advance such web and dispense it through said dispensing opening;

said feed mechanism further including a sensing element adapted to engage said primary web at a point remote from the primary towel roll and to be held in a first substantially fixed position by the presence of said primary web at said point throughout the period during which said primary web is intact between said web driving means and the primary towel roll, said feed mechanism being disabled during said period from delivering the web from said reserve roll station to said web driving means, said sensing element being responsive to an interruption of the continuity of said primary web at least one predetermined point between said web driving means and the primary towel roll to move to a second position, said movement of said sensing element actuating said feed mechanism to deliver said reserve web to said web driving means for advancing and dispensing thereby;

the cabinet interior being so constructed that an unobstructed path is provided during operation to permit the reserve towel roll to be manually transferred from said reserve towel station to said primary towel station after the reserve web has been delivered to and engaged by said web driving means, without breaking such web, rethreading it through said feed mechanism or movement of said sensing element.

6. A towel dispenser for sequentially dispensing toweling from rolls, comprising;

an enclosing cabinet having a dispensing opening;

a primary roll station for rotatably supporting a primary towel roll;

a reserve roll station for rotatably supporting a reserve towel roll in spaced relation above said primary roll station;

a feed mechanism including a drive roller, a pressure roller, a transfer roller and a sensing element, said drive and pressure rollers cooperating to form a nip through which the web from the primary towel roll and the web from the reserve towel roll may be sequentially driven and advanced toward said dispensing opening;

said transfer roller being normally held out of engagement with said drive and pressure rollers during the period that the primary towel web is connected from the primary towel roll to said nip, the reserve towel web hanging freely between said transfer roller and both the entrance side of said nip and the primary towel web during said period;

said sensing element being positioned to engage said primary web at a point remote from the primary towel roll, and being responsive to the interruption of continuity of the primary towel web at least one predetermined point between said nip and the primary towel roll to actuate said transfer roller to move into engagement with one of said pressure and drive rollers to be driven thereby and to deliver the free-hanging reserve towel web to said nip for advancing and dispensing thereby;

the cabinet interior being so constructed that an unobstructed path is provided during operation to permit the reserve towel roll to be manually transferred from said reserve towel station to said primary towel station after the reserve web has been delivered to and engaged by said web driving means, without breaking such web, rethreading it through said feed mechanism or movement of said sensing element.

* * * * *